US006069553A

United States Patent [19]

Black, III et al.

[11] Patent Number: 6,069,553

[45] Date of Patent: May 30, 2000

[54] BLOWER SPEED CONTROL RESISTORS FOR AUTOMOTIVE OR OTHER SERVICE

[75] Inventors: Charles E. Black, III; Daryn L. Waite, both of Mt. Prospect, Ill.

[73] Assignee: Indak Manufacturing Corp., Northbrook, Ill.

[21] Appl. No.: 08/947,574

[22] Filed: Oct. 9, 1997

Related U.S. Application Data

[60] Provisional application No. 60/046,901, May 9, 1997.

[51] Int. Cl.[7] ..... H01C 13/00

[52] U.S. Cl. ..... 338/215; 338/185; 338/52; 338/288; 338/289

[58] Field of Search ..... 338/215, 172, 338/185, 200, 20, 23, 52, 288, 289; 439/884, 601

[56] References Cited

U.S. PATENT DOCUMENTS

| | | | |
|---|---|---|---|
| 4,274,075 | 6/1981 | Schleicher | 338/172 |
| 4,827,241 | 5/1989 | Riser et al. | 338/172 |
| 4,847,587 | 7/1989 | Muller | 338/215 |
| 4,935,717 | 6/1990 | Osawa et al. . | |
| 5,107,243 | 4/1992 | Maeda | 338/172 |
| 5,445,541 | 8/1995 | May et al. | 439/595 |
| 5,563,570 | 10/1996 | Lee . | |

FOREIGN PATENT DOCUMENTS

| | | |
|---|---|---|
| 1262269 | 9/1961 | France . |
| 1541268 | 10/1968 | France . |
| 1407201 | 9/1975 | United Kingdom . |

*Primary Examiner*—Lincoln Donovan
*Assistant Examiner*—Richard K. Lee
*Attorney, Agent, or Firm*—Palmatier & Zummer; Francois N. Palmatier; Anthony S. Zummer

[57] ABSTRACT

A layered electrical resistor having flat components stacked as follows: a first metal outer plate, a first thin outer electrical insulator, a first thin sheet metal resistor element, a first thin inner insulator, a metal midplate, a second thin inner insulator, a second thin sheet metal resistor element, a second thin outer insulator and a second metal outer plate. The stacked components are compressed together by rivets or otherwise. Each sheet metal resistor element is stamped, punched or otherwise cut with at least first and second terminals and interconnected ribbons forming a resistive path therebetween. A thermal fuse or other circuit breaker is thermally engaged with a seat on the midplate and is connected in a series circuit with the resistor elements to open the circuit to prevent overheating thereof. Structural tie bars are formed integrally with ribbons and terminals of the resistor elements and are severable therefrom before assembly of the components. Bypass bars are integrally formed between ribbons of the resistor elements and are selectively serverable for adjusting their resistance. Each terminal is initially flat but is folded twice upon itself to form a layered wire-like prong. The midplate comprises sheared loops for receiving a prong after which the loops are clenched. The outer insulators are thinner than the inner insulators to conduct more heat to the midplate than to the outer plates whereby the thermal fuse opens the circuit before the outer plates become excessively heated.

38 Claims, 7 Drawing Sheets

38A,B
OFF
NOT OFF
HI
LO
M1
M2
m1
m2
Lo
B+

BLOWER SPEED CONTROL RESISTORS FOR AUTOMOTIVE OR OTHER SERVICE

The applicants claim the priority of their Provisional Application for Patent of the United States, Ser. No. 60/046, 901, filed May 9, 1997.

FIELD OF THE INVENTION

This invention relates to resistor constructions and pertains particularly to blower motor speed control resistors for automotive service, especially for automotive heating, air conditioning and ventilating systems. However, other applications for the invention will be evident to those skilled in the art.

BACKGROUND ON THE INVENTION

The traditional method of achieving automotive heater/air conditioning blower speed control is by use of an open coil resistor assembly consisting of one or more individual coil elements, usually connected electrically in series. Operation of the blower switch located on the vehicle instrument panel connects the blower motor to none, one, two or more of the resistance elements to progressively decrease the speed of the motor from its highest speed to lower ones. An advantage of the design is that the individual resistance values of the elements may readily be changed to optimize performance of an individual vehicle system design. The resistor assembly is usually located downstream of the motor and blower in the climate control air ducts built into the vehicle whereby the moving airstream cools the elements during normal operation. During a fault condition, such as failure of the blower motor shaft to rotate (locked rotor), open coil resistors may reach unacceptably high temperatures. A thermal fuse located above the resistance elements is often employed to limit the temperature rise during a fault condition by opening the resistor and motor circuit in response to an increase in convected and radiated heat from a resistance element. In other applications, the resistor assembly without a thermal fuse is located in an area where high temperatures will not adversely affect the surroundings.

Some other resistor products use flat plates, relying on resistive ink elements screen printed on either a ceramic or an enameled metal base and utilizing melting solder connections between the resistive elements to limit temperature rise during fault conditions.

SUMMARY OF THE INVENTION

The present invention reduces the maximum external temperature reached during both normal operation and fault conditions to an acceptable level for most applications. In one aspect, the present invention achieves this result by providing a layered electrical resistor comprising a first thermally conductive metal outer plate, a first thin flat electrical insulator having one side engaging the outer plate, a first thin flat electrically resistive sheet metal resistor element stacked against the first insulator, a second thin flat electrical insulator stacked against the first resistor element, an electrically and thermally conductive metal midplate stacked against the second insulator, a third thin flat electrical insulator stacked against the midplate, a second thin flat electrically resistive sheet metal resistor element stacked against the third insulator, a fourth thin flat electrical insulator stacked against the second resistor element, a second thermally conductive outer metal plate stacked against the fourth insulator, and means for connecting and compressing the first and second outer plates together with the insulators, the first and second resistor elements and the midplate securely compressed therebetween, each of the first and second resistor elements being in the form of an electrically resistive cut-formed sheet metal element having at least first and second end terminals and a pattern of ribbons interconnected in one piece and affording a continuous electrically resistive path between the first and second end terminals, the midplate and the outer plates being effective to dissipate the heat generated by the flow of electrical current in the resistor elements.

The layered resistor also preferably includes a thermal circuit breaker in a heat-conductive relation with the midplate, and means for connecting the first and second resistor elements and the thermal circuit breaker in a continuous electrical circuit, the thermal circuit breakers being initially conductive but becoming nonconductive when heated above a limiting temperature, whereby heat produced in the first and second resistor elements is thermally conducted by the midplate to the thermal circuit breaker which is effective to interrupt the flow of current in the resistor elements to prevent development of an unacceptably high temperature therein. The midplate preferably comprises means forming a seat for thermally conductive engagement by the thermal circuit breaker, which is in thermally conductive engagement with the seat.

In another aspect, the present invention provides a layered electrical resistor comprising a first thermally conductive metal plate, a first thin flat electrical insulator having one side engaging the first plate, a thin flat electrically resistive sheet metal resistor element stacked against the first insulator, a second thin flat electrical insulator stacked against the resistor element, a second thermally conductive metal plate stacked against the second insulator, and means for connecting and compressing said first and second plates together with the insulators and the resistor element securely compressed therebetween, the resistor element being in the form of an electrically resistive cut-formed sheet metal element having at least first and second end terminals and a pattern of ribbons interconnected in one piece and affording a continuous electrically conductive path between the first and second end terminals, the plates being effective to dissipate the heat generated by the flow of electrical current in the resistor element. The layered resistor may also comprise a thermal circuit breaker in a heat-conductive relation with at least one of the plates, and means for connecting the resistor element and the thermal circuit breaker in a continuous electrical circuit, the thermal circuit breaker being initially conductive but becoming nonconductive when heated above a limiting temperature, whereby heat produced in the resistor element is thermally conducted to the thermal circuit breaker which is effective to interrupt the flow of current in the resistor element to prevent development of an unacceptably high temperature therein.

In another aspect, the present invention provides a layered resistor element comprising a thin flat electrically resistive cut-formed sheet metal element having portions forming at least first and second end terminals and a pattern of ribbons interconnected in one piece and affording a continuous electrically resistive path between the end terminals, each of the terminals comprising a generally rectangular tab which is initially flat but is folded twice upon itself to form the tab into a layered wire-like prong on the corresponding terminal.

The resistor element may also comprise at least one integral structural tie bar extending between at least one of the ribbons and at least one of the terminals for initially imparting enhanced structural integrity to the resistor element, the tie bar being severable from the resistor element prior to going into service.

The resistor element may also comprise at least one resistance adjusting bypass bar connected initially in one piece between two of the ribbons for electrically bypassing portions thereof and thereby reducing the electrical resistance of the resistor element, the resistance adjusting bypass tie bar being optionally severable from the resistor element prior to its going into service.

In another aspect, the present invention provides a layered electrical resistor having the following stacked components: A first thermally conductive metal outer plate, a first thin flat electrical insulator, a first thin flat electrically resistive sheet metal resistor element, a second thin flat electrical insulator, an electrically and thermally conductive metal midplate, a third thin flat electrical insulator, a second thin flat electrically resistive sheet metal resistor element, a fourth thin flat electrical insulator, a second thermally conductive outer metal plate, and means for connecting and compressing the first and second outer plates together, with the insulators, the first and second resistor elements and the midplate securely compressed therebetween, each of the first and second resistor elements being in the form of an electrically resistive sheet metal stamping having at least first and second end terminals and a pattern of ribbons interconnected in one piece and affording a continuous electrically resistive path between the first and second end terminals, the midplate and the outer plates being effective to dissipate the heat generated by the flow of electrical current in said resistor elements.

The layered resistor also preferably includes a thermal circuit breaker in a heat-conductive relation with the midplate, and means for connecting the first and second resistor elements and the thermal circuit breaker in a continuous electrical circuit, the thermal circuit breaker being initially conductive but becoming non-conductive when heated above a limiting temperature, whereby excessive heat produced in said first and second resistor elements is thermally conducted by the midplate to the thermal circuit breaker which is effective to interrupt the flow of current in the resistor elements to prevent development of an unacceptably high temperature therein.

In the layered resistor, the second and third insulators are substantially thinner than the first and fourth electrical insulators so that the heat conductivity of the second an third insulators is substantially greater than the heat productivity of the first and fourth insulators, whereby heat generated in the first and second resistor elements is conducted at a greater rate by the second and third insulators to the midplate than the rate of heat conduction by the first and second insulators to the outer plates, so that the midplate is hotter than the outer plates and is effective under fault conditions to cause the thermal circuit breaker to interrupt the flow of electrical current in the resistor elements before an unacceptably high temperature is developed in the outer plates.

The thermal circuit breaker is preferably a thermal fuse. The midplate preferably comprises means forming a seat for thermally conductive engagement by the thermal circuit breaker.

The layered resistor also preferably includes at least one flange on the midplate for forming the seat thereon for engagement by the thermal circuit breaker.

At least one of the resistor elements preferably comprises at least one structural tie bar extending in one piece between at least one of the ribbons and at least one of the terminals for initially imparting enhanced structural integrity to the resistor element, the tie bar being severable from the resistor element prior to assembly thereof with the other components of the resistor.

Each of the resistor elements preferably comprises at least one resistance adjusting bypass tie bar formed initially in one piece between two of the ribbons for electrically bypassing portions thereof and thereby reducing the electrical resistance of the resistor elements, the resistance adjusting bypass tie bar being optionally severable from the resistor element prior to assembly thereof with the other components of the resistor for increasing the electrical resistance of the last-mentioned resistor element.

Each of the end terminals of the resistor elements preferably comprises a generally rectangular tab which is initially flat but is folded twice upon itself to form the tab into a three-layer wire-like prong thereon.

The midplate preferably comprises a plurality of terminal receiving portions having respective sets of metal loops sheared from the midplate, one prong on each of the resistor elements being received in one set of the loops for establishing an electrical connection thereto, the resistor including a terminal lead received in another set of the loops, the loops being adapted to be clenched against the terminal prong and the terminal lead for clamping engagement therewith to provide secure electrical connections thereto.

The layered resistor preferably comprises an electrically insulating terminal head having a plurality of metal terminal prongs mounted thereon, the terminal prongs having metal loops sheared therefrom for receiving certain of the wire-like prongs on the resistor elements, the loops being adapted to be clenched against the wire-like prongs into clamping engagement therewith.

The terminal head preferably comprises a pair of supporting channels formed in one piece therewith and extending transversely thereto, the midplate having edge portions for reception in the channels whereby the channels support the midplate.

The first resistor element preferably comprises an intermediate terminal and a plurality of ribbons interconnected in one piece and affording a continuous electrically resistive path between the first end terminal and the intermediate terminal and also between the intermediate terminal and the second end terminal of the first resistor element.

The intermediate terminal preferably comprises a generally rectangular tab which is initially flat but is folded twice upon itself to form the tab into a three-layer wire-like prong thereon.

In the layered resistor, the thermal circuit breaker preferably has a terminal lead connected to the midplate, whereby the midplate establishes an electrical connection between the circuit breaker and the corresponding prong of the resistor element.

In another aspect, the invention provides a layered electrical resistor comprising a first thermally conductive metal plate, a first thin flat electrical insulator having one side engaging the first plate, a thin flat electrically resistive sheet metal resistor element stacked against the first insulator, a second thin flat electrical insulator stacked against the resistor element, a second thermally conductive metal plate stacked against the second insulator, and means for connecting and compressing the first and second plates together, with the insulators and the resistor element securely compressed therebetween. The resistor element being in the form of an electrically resistive sheet metal stamping having at least first and second end terminals and a plurality of ribbons interconnected in one piece and affording a continuous electrically conductive path between the first and second end terminals, the plates being effective to dissipate the heat generated by the flow of electrical current in the resistor element.

The layered resistor preferably includes a thermal circuit breaker in a heat-conductive relation with at least one of the plates, and means for connecting the resistor element and the circuit breaker in a continuous electrical circuit. The thermal circuit breaker is initially conductive but becomes non-conductive when heated above a limiting temperature, whereby excessive heat produced in the resistor element is effective to interrupt the flow of current in the resistor element to prevent development of an unacceptably high temperature therein. The thermal circuit breaker is preferably a thermal fuse.

One of the plates preferably comprises means forming a seat for thermally conductive engagement by the thermal circuit breaker which is in thermal conductive engagement with the seat.

At least one flange is preferably provided on the corresponding plate for forming the seat thereon for engagement by the thermal circuit breaker.

The resistor element preferably comprises at least one structural tie bar extending in one piece between at least one of said ribbons and at least one of the terminals for initially imparting enhanced structural integrity to the resistor element, the tie bar being severable from the resistor element prior to assembly thereof with the other components of the resistor.

The resistor element preferably comprises at least one resistance adjusting bypass tie bar formed initially in one piece between two of the ribbons for electrically bypassing portions thereof and thereby reducing the electrical resistance of the resistor element, the bypass tie bar being optionally severable from the resistor element prior to assembly thereof with the other components of the resistor for increasing the electrical resistance of the resistor element.

Each of the end terminals of the resistor element preferably comprises a generally rectangular tab which is initially flat but is folded twice upon itself to form the tab into a three-layer wire-like prong thereon.

One of the plates preferably comprises at least one terminal receiving portion having metal loops sheared therefrom for receiving one of the wire-like prongs on the resistor element to connect the resistor element to such plate. The loops are adapted to be clenched against the prong for clamping engagement therewith.

In another aspect, the invention provides a resistor element comprising a thin flat electrically resistive sheet metal stamping having portions forming first and second end terminals and a plurality of ribbons interconnected in one piece and affording a continuous electrically resistive path between the first and second end terminals. Each of the terminals comprises a generally rectangular tab which is initially flat but is folded twice upon itself to form the tab into a three-layer wire-like prong on the corresponding terminal.

The resistor element preferably comprises a multiplicity of the ribbons connected in series in a generally serpentine pattern and extending between the first and second end terminals in one piece therewith.

Alternatively, the resistor element preferably comprises a multiplicity of ribbons formed in one piece with the terminals and extending in a plurality of parallel paths between such terminals.

The resistor element preferably comprises at least one structural tie bar extending between at least one of the ribbons and at least one of the terminals for initially imparting enhanced structural integrity to the resistor element. Such tie bar is severable from the resistor element prior to its going into service.

The resistor element also preferably includes at least one resistance adjusting bypass tie bar formed initially in one piece between two of the ribbons for electrically bypassing portions thereof and thereby reducing the electrical resistance of the resistor element. The bypass tie bar is optionally severable from the resistor element prior to its going into service.

The resistor element may comprise an intermediate terminal between the first and second end terminals. Some of the ribbons are interconnected in one piece and afford a continuous electrically conductive path between the first end terminal and the intermediate terminal. Other ribbons are interconnected in one piece to afford a continuous electrically resistive path between the intermediate terminal and the second end terminal.

The specific embodiment of the resistance element as disclosed herein consists of a sandwich or layered assembly of essentially flat sheet metal stampings or cut-formed sheet metal assembled in the following order: a first outer metal plate, an outer insulator, a flat, stamped or otherwise cut sheet metal resistance element, an inner insulator, a midplate, another inner insulator, another flat, stamped or otherwise cut sheet metal resistance element, another outer insulator and a second outer metal plate. Because the components are flat they may be held in intimate contact with one another to facilitate conductive heat transfer from the resistance elements, which transform electrical energy into heat, to the outer plates which are located in the cooling airstream.

Common tooling may be used to stamp or otherwise cut the basic resistive elements from thin resistive sheet metal stock. Structural tie bars or webs which are subsequently removed at the assembly point are left between resistive paths for structural integrity during handling. The resistive elements may be designed with parallel paths to spread the generation of heat over a larger area. Alternatively, series paths may be required to obtain high enough element resistance in the package size allowed. Regardless, additional bypass tie bars or bridges are also left which create parallel paths in the individual resistive elements. Making minor changes in the assembly tooling permits trimming out some of these bypass tie bars at the same operation where the structural tie bars are removed, permitting flexibility in the choice of resistance of the individual elements without significant cost effect.

Another necessity for the new design is a high integrity connection of the resistance elements to each other and to the external circuit connection means. Connection of the resistance elements to the terminals is accomplished by folding the resistive material into a three-layer thickness "tube" or wire-like prong without cutting it. The "tube" may then be assembled by the same high reliability techniques previously employed for the round wire resistance elements of the prior construction wherein shear formed loops in the terminals are pressed or clenched against the ends or prongs of the resistance elements, forming a mechanically and electrically sound and secure junction. Connection of one resistance element to another may be accomplished by means of a tie bar if size restrictions allow both elements to be on the same side of the midplate. To minimize the overall package size, however, at least one element of a two or more element design will be positioned on opposite sides of the midplate. Shear formed loops in the midplate itself may then act as connecting means when pressed against the "tubes" or wire-like prongs formed on the flat resistance elements.

When a thermal fuse is used between the "last" resistance element and the output terminal, the midplate is used to connect the resistance element or elements to the thermal fuse both electrically and thermally. The thermal fuse is engaged with the midplate for good conductive heat transfer, a method superior to prior coil designs using convective and radiative means but already incorporated in the ceramic and enameled metal base designs. The circuit-opening temperature of the thermal fuse is selected to lie between the maximum thermal fuse temperature reached during normal operation and the minimum thermal fuse temperature reached during a fault condition where the airstream ceases due to locked rotor failure of the blower motor. Opening of the thermal fuse limits the temperature rise of the outer plates to one safe for the surroundings.

The inner insulators located in contact with the midplate and the outer insulators located in contact with the outer plates may be of different thicknesses to better control the rate of temperature rise of the outer plates during a locked rotor fault condition. Preferably, the outer insulators are made thicker than the inner insulators so that the thermal conductivity between the flat resistance elements and the midplate is greater than the thermal conductivity between the resistance elements and the outer plates. In this way, the midplate is heated more rapidly than the outer plates during a fault condition due to interruption of the air stream caused by a locked rotor in the blower motor. The thermal fuse or limiter is also heated more rapidly, because it is in thermal contact with the midplate. Consequently, the thermal fuse is heated to its circuit-opening temperature before the outer plates are heated to an unacceptably high temperature.

BRIEF DESCRIPTION OF THE DRAWINGS

Further objects, advantages and features of the present invention will appear from the accompanying drawings, in which:

FIG. 21 is a fragmentary plan view showing the flat sheet metal projection on the original blank stamping of the resistor element, before the projection is folded to form the prong.

FIG. 22 is an end elevational view of the flat projection of FIG. 21.

FIG. 23 is an end elevational view of the prong after its formation has been completed by folding the flat projection shown in FIGS. 21 and 22.

DETAILED DESCRIPTION OF AN ILLUSTRATIVE EMBODIMENT

Figure 1:
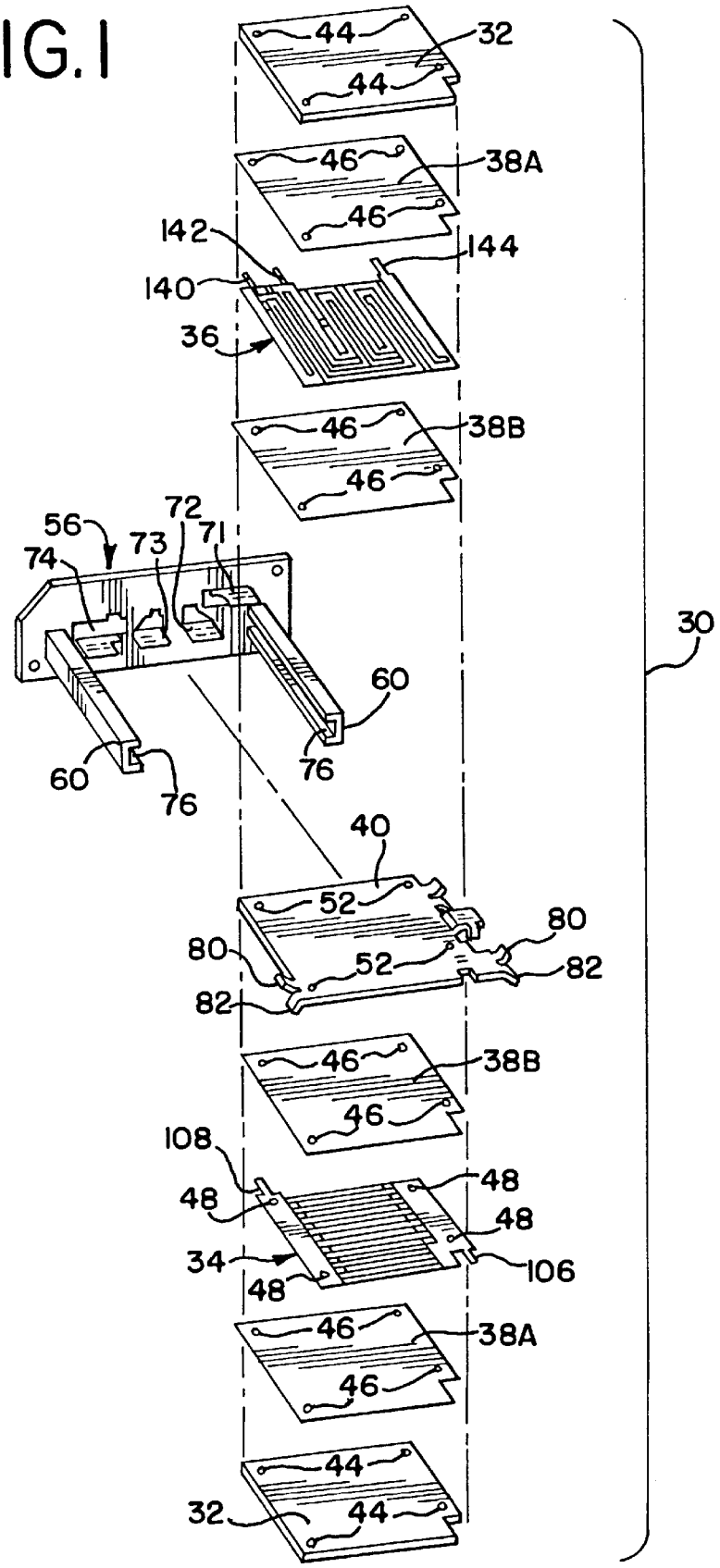
FIG. 1 is an exploded view of a disassembled flat profile resistor package or unit to be described as an illustrative embodiment of the present invention.
Figure 2:
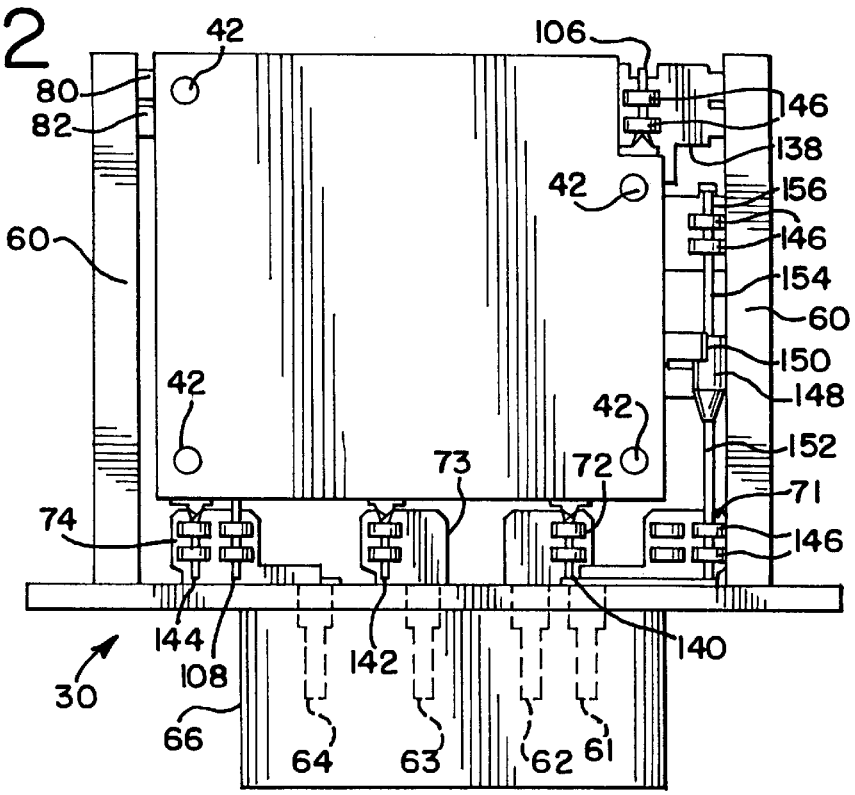
FIG. 2 is a plan view of the resistor unit of FIG. 1.
Figure 3:
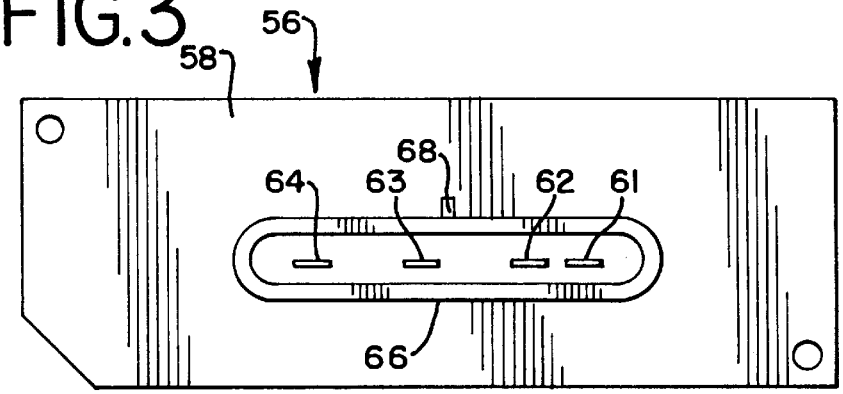
FIG. 3 is a front elevational view of the resistor unit.
Figure 4:
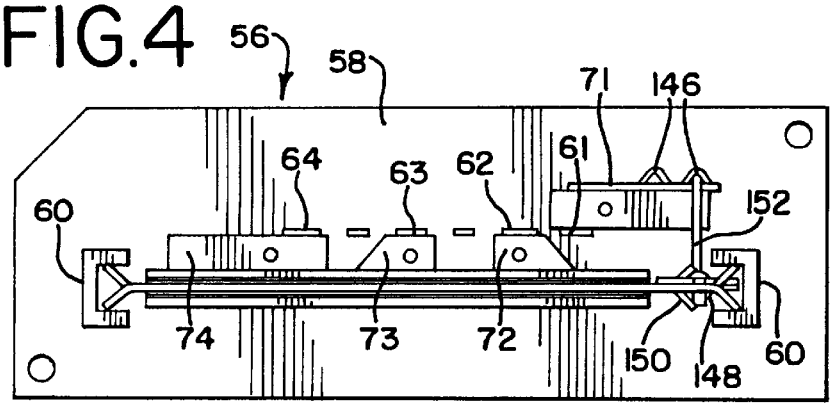
FIG. 4 is a rear elevational view of the resistor unit.

As just indicated, FIG. 1 is an exploded view of a resistor unit 30 to be described as an illustrative embodiment of the present invention. The fully assembled resistor unit 30 is shown in FIGS. 2, 3 and 4. The resistor unit 30 is sometimes referred to herein as the resistor 30.

As shown in FIG. 1, the resistor unit 30 comprises a multiplicity of generally flat, plate-like components which are adapted to be stacked and riveted or otherwise fastened together. The stack of components, as shown in FIG. 1, is sandwiched or layered between a pair of outer plates 32 which are located at the opposite ends of the stack. The outer plates 32 are preferably made of sheet metal, such as aluminum, for example, because of its good heat conductivity, and are sufficiently thick to be substantially rigid.

The stack of FIG. 1 also comprises first and second thin, flat resistor elements 34 and 36, made at least in part of electrically conductive material, preferably thin sheet metal, such as some type of aluminum chromium iron alloy or other alloy which has a desirable electrical resistivity and is resistant to corrosion. Several commercial resistive materials have been employed successfully, including Alchrome D, Kanthal D and Hoskins 815. Other commercially available, electrically resistive metal materials can be used. Preferably, the resistor elements 34 and 36 are fairly thin, such as approximately 0.25 millimeter, for example.

The stack of components of the resistor unit 30 comprises outer and inner thin, flat insulators 38A and 38B to provide electrical insulation on both the outer sides and the inner sides of the first and second resistor elements 34 and 36. The insulators 38A and 38B are in the form of thin, flat sheets, preferably made of a resinous plastic material which is capable of withstanding high temperatures ranging up to approximately 220 degrees C., that may be produced by the resistor elements 34 and 36 under certain conditions. For example, insulators 38A and 38B may be made of DUPONT KAPTON HN sheet material or DUPONT NOMEX sheet material, or other equivalent materials.

There are two of the outer insulators 38A, the first of which is stacked between the outer plate 32 and the outer side of the first resistor element 34. The second outer insulator 38A is sandwiched or layered between the other outer plate 32 and the outer side of the second resistor element 36. Likewise, there are two of the inner insulators 38B, the first of which is sandwiched or layered between midplate 40 and the inner side of the first resistor element 34. The second inner insulator 38B is sandwiched or layered between the midplate 40 and the inner side of the second resistor element 36, as shown in FIG. 1. Preferably, the outer insulators 38A are thicker than the inner insulators 38B so that the thermal conductivity between each of the flat resistor elements 34 and 36 and the midplate 40 is greater than the thermal conductivity between each of the resistor elements 34 and 36 and the corresponding outer plates 32. As a result, the midplate 40 is heated more rapidly than the outer plates 32 during a fault condition due to interruption of the air stream caused by a locked rotor in the blower motor. The thermal fuse or limiter 148 is also heated more rapidly because it is in thermal contact with the midplate 40. Consequently, the thermal fuse is heated to its circuit-opening temperature before the outer plates 32 are heated to an unacceptably high temperature. In a presently preferred embodiment, each of the outer insulators 38A has a thickness of 0.50 mm, while each of the inner insulators 38B has a thickness of 0.13 mm. It will be understood that the thickness can be varied.

As shown in FIG. 1, the stacked components of the resistor unit 30 comprise a midplate 40, preferably in the form of sheet metal, which may be made of steel, for example, or any other suitable metal or alloy having good electrical and heat conductivity. Ordinary, low-cost, SAE 1010 carbon steel has been successfully employed for the midplate 40. The thickness of the midplate 40 can be less than the thickness of the outer plates 32. For example, a midplate 40 having a thickness of approximately 0.81 millimeter has been successfully employed in a resistor unit 30 having outer plates 32 made of aluminum sheet metal with a thickness of approximately 1.52 millimeters. Outer plates 32 made of steel can also be employed.

In FIG. 1, the various flat components of the resistor unit 30 are stacked vertically in the following order, starting with the lower end of the illustrated stack: one of the outer plates 32, one of the outer insulators 38A, the first resistor element 34, one of the inner insulators 38B, the midplate 40, another inner insulator 38B, the second resistor element 36, another outer insulator 38A and the second outer plate 32.

Figure 5:
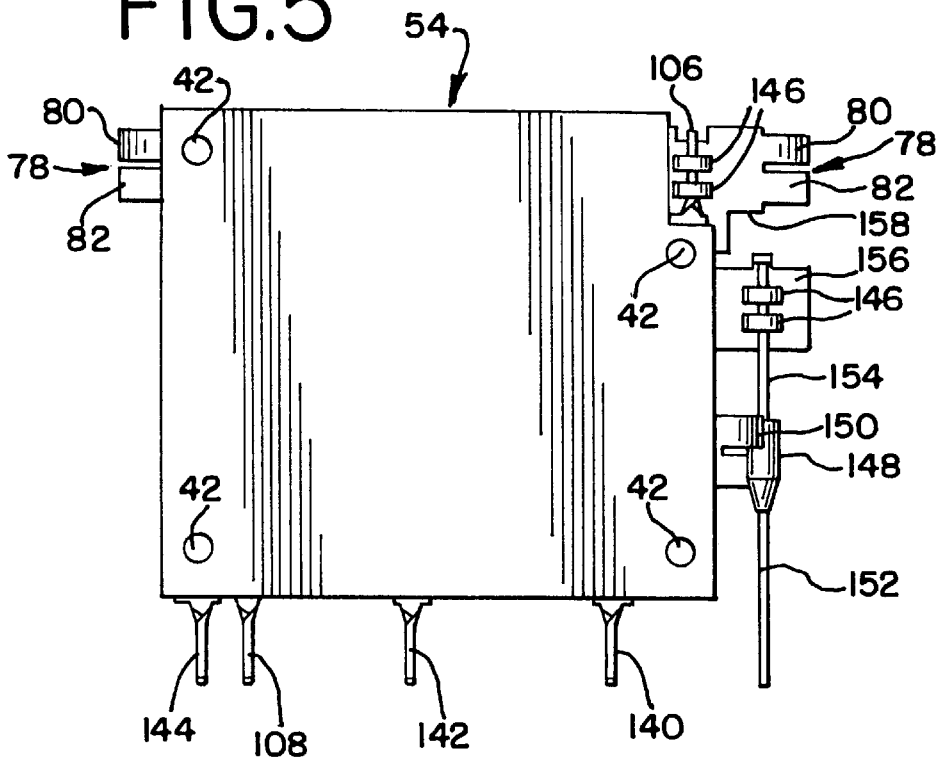
FIG. 5 is a plan view of the partially assembled resistor unit, before it is assembled with the terminal head.

The stacked components of the resistor unit 30 are riveted or otherwise fastened together to form a secure assembly, as shown in FIGS. 2, 4, 5 and 6. The heads of four rivets 42 are shown in FIGS. 2 and 5. Four holes 44 for receiving the rivets 42 or other fasteners are formed in the outer plates 32. Similarly, four fastener holes 46 are formed in each of insulators 38A and 38B.

Figure 8:
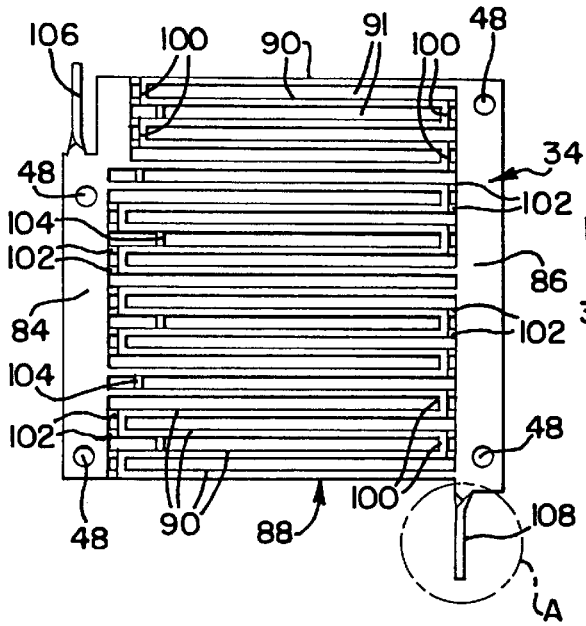
FIGS. 8 and 9 are plan views of the first and second resistor elements, as they are originally stamped or otherwise produced, and showing all the original tie bar elements still in place.
Figure 9:
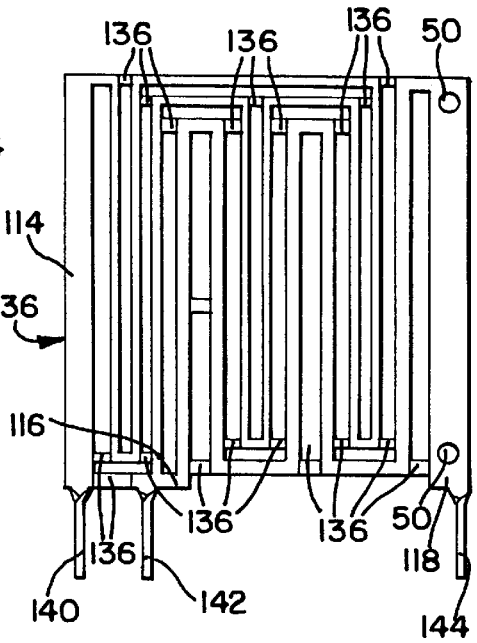

As shown to best advantage in FIG. 8, the first resistor element 34 is formed with four holes 48 for receiving the rivets 42 or other fasteners. The holes 48 are oversize clearance holes, relative to the shank diameter of the rivets 42, so that the rivets will not engage the first resistor element 34. As shown in FIG. 9, the second resistor element 36 is formed with only two oversize clearance holes 50 for receiving two of the rivets 42, without engaging them. The midplate 40 is formed with four oversize clearance holes 52 for receiving all four rivets without engaging them.

The rivet holes 44 in the outer plates 32 are smaller than the oversize clearance holes 48, 50 and 52 and are only slightly larger that the shank diameter of the rivets 42, so as to locate and center the rivets 42 in the clearance holes 48, 50 and 52 in the resistor elements 34 and 36 and the midplate 40, respectively. The rivet holes in the outer and inner insulators 38A and 38B are also smaller than the clearance holes 48, 50 and 52.

Figure 6:
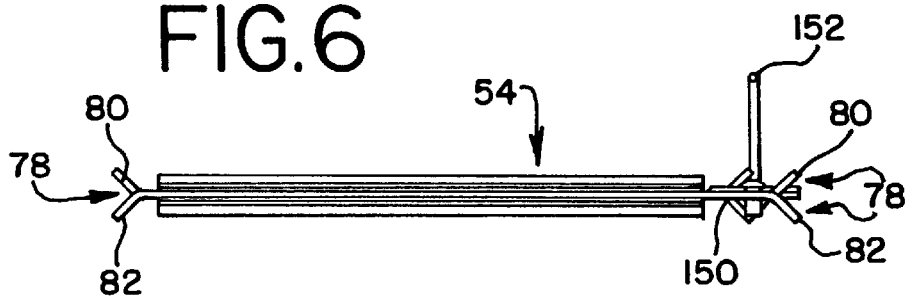
FIG. 6 is a rear elevational view of the partially assembled resistor unit of FIG. 5.

The components of the resistor unit 30, when stacked and riveted together as described thus far, form a subassembly 54 which is illustrated separately in FIGS. 5 and 6. The subassembly 54 is adapted to be assembled with a terminal head 56, illustrated separately in FIG. 1. The assembled combination of the subassembly 54 and the terminal head 56 constitutes the complete resistor unit 30, which is shown in a fully assembled state in FIGS. 2, 3 and 4.

As shown in FIGS. 1 and 2, the terminal head 56 comprises a front plate 58 and a pair of side arms or channels 60 projecting rearwardly from the front plate 58 for supporting the subassembly 54. As shown, the side arms 60 are substantially perpendicular to the front plate 58. Preferably, the front plate 58 and the side arms 60 are molded in one piece from a resinous plastic material which is capable of withstanding the heat generated by the resistor unit 30 under certain conditions. For example, the terminal head 56 is preferably molded in one piece of glass filled nylon comprising a high-temperature nylon resin having glass reinforcing fibers imbedded therein.

To establish electrical connections to the resistor elements 34 and 36, the terminal head 56 comprises four flat electrically-conductive terminal prongs 61, 62, 63 and 64, extending through the front plate 58 and projecting forwardly therefrom for receiving a connector plug (not shown) whereby the resistor unit 30 is connected into the electrical system of the vehicle. The prongs 61, 62, 63 and 64 are made of an electrically conductive metal, preferably copper, having a corrosion resistant plating thereon. However, the prongs may also be made of a less expensive metal such as plated steel, for example.

As shown in FIGS. 2 and 3, the four prongs 61–64 are surrounded and protected by a hollow tubular housing 66 for receiving the body of a connector plug (not shown). The housing 66 projects forwardly from the front plate 58 and is preferably molded in one piece with the front plate 58 and the side arms 60. As viewed in FIG. 3, the housing 66 is generally oval in shape. A rib 68 projects upwardly from the housing 66 to interfit with a component of the connector plug.

The four terminal prongs 61, 62, 63 and 64 are formed in one piece with respective electrically conductive terminals 71, 72, 73 and 74, mounted on and projecting rearwardly from the front plate 58 of the terminal head 56. The first and second resistor elements 34 and 36 are electrically connected to the terminals 71, 72, 73 and 74, in a manner which will be described subsequently herein.

As shown in FIG. 4, the side arms 60 of the terminal head 56 are adapted to support the subassembly 54 of the resistor unit 30. As shown most clearly in FIG. 1, the side arms 60 of the terminal head 56 are formed with oppositely facing channels 76 for receiving and supporting edge portions of the subassembly 54. As illustrated in FIGS. 4, 5 and 6, such edge portions take the form of flange means 78 on the opposite side edges of the midplate 40. More specifically, such flange means 78 may comprise lower flanges or tabs 80 bent downwardly at approximately 45 degrees on both edge portions of the midplate 40, and upper flanges or tabs 82 bent upwardly at approximately 45 degrees on both edge portions of the midplate 40, as shown most clearly in FIGS. 5 and 6. The lower and upper flanges 80 and 82 are slidably receivable in the channels 76 formed in the side arms 60 of the terminal head 56, as clearly shown in FIG. 4. The flange means 78 have an interference fit with the channels 76 for the last part of their travel during assembly to provide mechanical support of the subassembly 54 in service. Flanges having other shapes can be employed.

Figure 10:
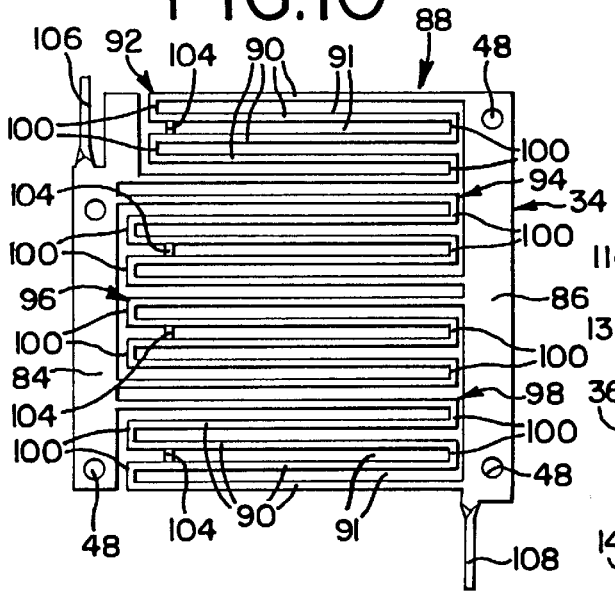
FIGS. 10 and 11 are plan views of the first and second resistor elements with some of the tie bar elements removed to adjust the resistance values.
Figure 12:
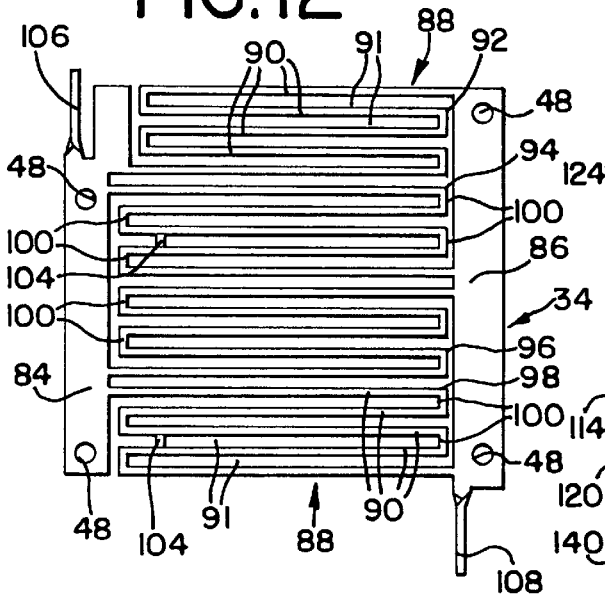
FIGS. 12 and 13 are plan views of the first and second resistor elements with a different set of the tie bar elements removed to produce different resistance values.

The details of the construction of the first resistor element 34 are shown in FIGS. 8, 10 and 12. The first resistor element 34 is illustrated as comprising first and second flat terminal conductors 84 and 86 and resistive maze means 88 extending between them. The first and second terminal conductors 84 and 86 and the resistive maze means 88 are preferably stamped, punched, cut or otherwise formed from the electrically resistive sheet metal of which the first resistor element 34 is made. As shown, the first and second terminal conductors 84 and 86 consist of sheet metal strips or portions extending along the opposite edges of the first resistor element 34 as initially stamped (FIG. 8), the resistive maze means 88 comprise a considerable number of narrow resistive ribbons 90 extending transversely in the space between the first and second terminal conductors 84 and 86. A considerable number of narrow transverse slots 91 are formed between the resistive ribbons 90.

Referring to FIGS. 8, 10 and 12, the resistive maze means 88 comprise interconnecting means whereby the resistive ribbons 90 are adapted to be connected in one or more zigzag or serpentine resistive paths between the first and second terminal conductors 84 and 86. Four such paths 92, 94, 96 and 98 are shown. To form such paths, some of the left-hand ends and some of the right-hand ends of the transverse resistive ribbons 90 are connected together by short perpendicular ribbons 100, spaced away from the first and second terminal conductors 84 and 86. As shown in FIGS. 8, 10 and 12, there are 20 of the transverse ribbons 90 in the illustrated construction. If the ribbons 90 are counted from the upper end of FIG. 10, some of the perpendicular ribbons 100 are connected between the left-hand ends of the first and second ribbons 90, the third and fourth ribbons 90, the seventh and eighth ribbons 90, the ninth and tenth ribbons 90, the eleventh and twelfth ribbons 90, the thirteenth and fourteenth ribbons 90, the seventeenth and eighteenth ribbons 90 and the nineteenth and twentieth ribbons. Other perpendicular ribbons 100 are connected between the right-hand ends of the second and third ribbons 90, the fourth and fifth ribbons 90, the sixth and seventh ribbons 90, the eighth and ninth ribbons 90, the twelfth and thirteenth ribbons 90, the fourteenth and fifteenth ribbons 90, the sixteenth and seventeenth ribbons 90 and the eighteenth and nineteenth ribbons 90.

The left-hand ends of the fifth, sixth, fifteenth and sixteenth transverse ribbons 90 are connected directly to the first terminal conductor 84. The right-hand ends of the first, tenth, eleventh and twentieth transverse ribbons 90 are connected directly to the second terminal conductor 86. As shown most clearly in FIGS. 10 and 12, the first serpentine resistive path 92 is adapted to be formed by the first, second, third, fourth and fifth transverse ribbons 90 and the corresponding perpendicular ribbons 100. The second serpentine resistive path 94 is adapted to be formed by the sixth, seventh, eighth, ninth, and tenth transverse ribbons 90 and the corresponding perpendicular ribbons 100. The third serpentine resistive path 96 is adapted to be formed by the eleventh, twelfth, thirteenth, fourteenth and fifteenth transverse ribbons 90 and the corresponding perpendicular ribbons 100. The fourth serpentine resistive path 98 is adapted to be formed by the sixteenth, seventeenth, eighteenth, nineteenth and twentieth transverse ribbons 90 and the corresponding perpendicular ribbons 100. As shown in FIGS. 10 and 12, the four serpentine resistive paths 92, 94, 96 and 98 are connected electrically in parallel between the first and second terminal conductors 84 and 86.

FIG. 8 shows the first resistor element 34 in its initial condition, after it has been stamped from the electrically resistive sheet metal. In this condition, the four serpentine resistive paths 92, 94, 96 and 98 are connected to the first and second flat terminal conductors 84 and 86 by a plurality of temporary severable supporting webs 102. More specifically, in the construction illustrated in FIG. 8, each of the perpendicular resistive ribbons 100 is connected to either the first or the second flat terminal conductor 84 or 86 by two of the temporary severable supporting webs 102 which are formed in one piece with the first and second terminal conductors 84 and 86 and with the perpendicular ribbons 100. The supporting webs 102 are simply left intact by the initial stamping of the flat resistor element 34. In the specific construction of FIG. 8, there are 16 of the supporting webs 102 connected between the first terminal conductor 84 and the adjacent perpendicular ribbons 100, plus 16 additional supporting webs 102 connected between the second terminal conductor 86 and the adjacent perpendicular ribbons 100. The retention of the supporting webs 102 during the initial stamping of the first resistor element 34 maintains the structural integrity of the resistor element 34 so that it can be handled and shipped without any difficulty.

Before the first resistor element 34 is assembled with the other components to form the finished resistor 30, the first resistor element 34 is subjected to a punching or other severing operation whereby all of the temporary severable supporting webs 102 are severed or otherwise removed from the original positions between the perpendicular resistive ribbons 100 and the adjacent first and second flat terminal conductors 84 and 86. FIGS. 10 and 12 illustrate the resistor element 34 with all of the temporary severable supporting webs 102 removed whereby all of the four serpentine resistive paths 92, 94, 96 and 98 are electrically normalized. However, the first resistor element 34 is somewhat lacking in structural integrity, so that it must be carefully handled when it is assembled with the other components to form the finished resistor 30.

When the first resistor element 34 is originally stamped from the resistive sheet metal, as shown in FIG. 8, the resistor unit 34 includes a plurality of severable bypass webs or links 104 which extend between adjacent pairs of the transverse resistive ribbons 90 whereby portions of the serpentine resistive paths 92, 94, 96 and 98 are electrically bypassed or short-circuited. In the specific construction of FIG. 8, the first resistor element 34 comprises six of the severable bypass links 104.

When the resistor element 34 is subjected to the punching or severing operation to remove the temporary severable supporting webs 102, as previously described, some or all of the severable bypass links 104 may also be removed to adjust the resistance value of the first resistor element 34. In the finished form of the resistor unit 34 as shown in FIG. 10, two of the six bypass links 104 have been removed, so that only four of the bypass links 104 remain. The first or uppermost remaining bypass link 104 in FIG. 10 bypasses or short-circuits a portion of the first serpentine resistive path 92 and thereby reduces the electrical resistance thereof. The second remaining bypass link 104 bypasses or short-circuits a portion of the second serpentine resistive path 94, so that its electrical resistance is reduced. The third remaining bypass link 104 bypasses or short-circuits a portion of the third serpentine resistive path 96 so that its electrical resistance is reduced. The fourth or lower-most remaining bypass link 104 bypasses or short-circuits a portion of the fourth serpentine resistive path 98 so that its electrical resistance is reduced.

In the modified construction of the resistor element 34, as shown in FIG. 12, only two of the severable bypass links remain after the punching or severing operation. The upper of the two remaining bypass links 104 bypasses or short-circuits a portion of the second serpentine resistive path 94 so that its electrical resistance is correspondingly reduced. The lower of the two remaining bypass links 104 in FIG. 12 bypasses or short-circuits a portion of the fourth serpentine resistive path 98, so that its electrical resistance is reduced.

It will be understood that the total number and location of the severable bypass links 104 can be varied, and that all or any desired number of the severable bypass links 104 can be removed during the punching or severing operation, whereby the electrical resistance of the first resistor element 34 can be varied, as desired.

As shown in FIGS. 8, 10 and 12, the first and second flat terminal conductors 84 and 86 of the first resistor element 34 are formed with first and second wire-like terminal prongs 106 and 108, which are formed in one piece with the respective terminal conductors 84 and 86.

Figure 21:
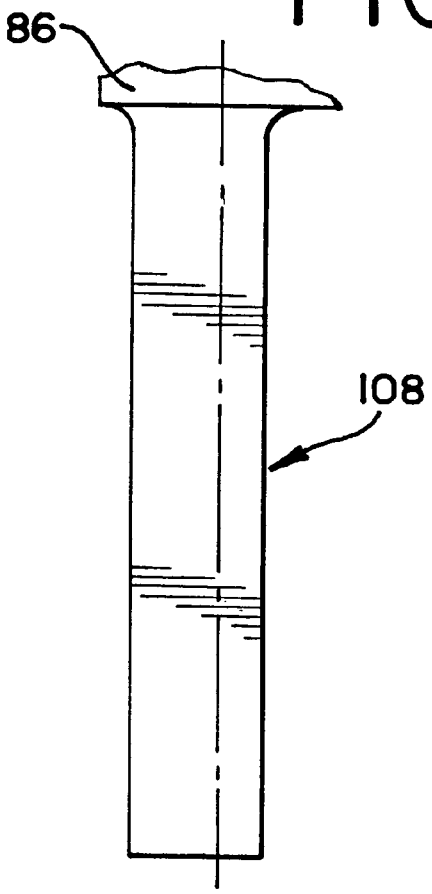
FIGS. 21, 22 and 23 are enlarged views illustrating the formation of the prong detail shown in circle A in FIG. 8.
Figure 22:
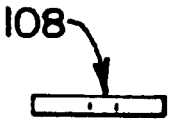
Figure 23:
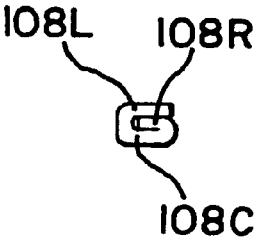

The manner in which the second wire-like terminal prong 108 is formed is shown in FIGS. 21, 22 and 23. The first wire-like prong 106 is formed in the same manner on the first flat terminal conductor 84. As shown in FIGS. 21 and 22, the prong 108 is flat and in the plane of the flat terminal conductor 86. As shown in FIG. 23, the wire-like terminal prong 108 is formed into its final shape by folding the right- and left-hand portions of the flat terminal prong 108 against the central portion thereof. As shown in the end view of FIG. 23, the right-hand portion of the prong 108 is designated 108R, the left-hand portion is designated 108L, and the central portion is designated 108C. FIG. 23 is a greatly enlarged end view of the completed wire-like terminal prong.

Figure 11:
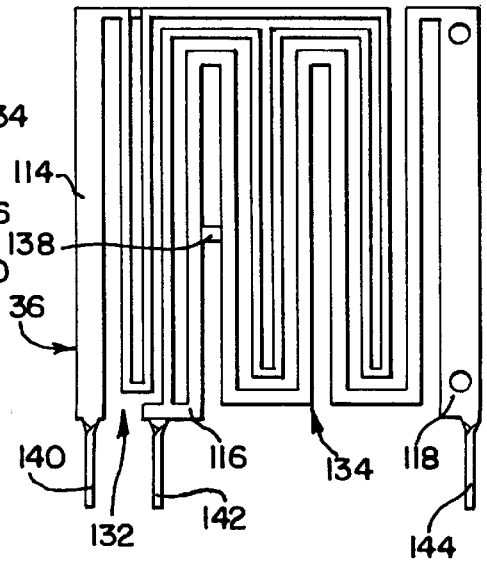
Figure 13:
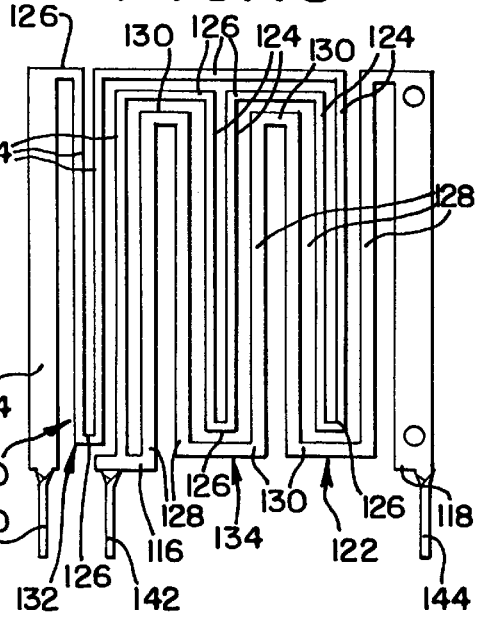
Figure 15:
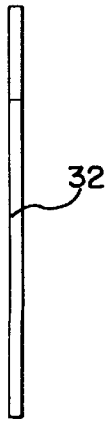
FIG. 15 is an edge elevational view of the outer plate shown in FIG. 14.
Figure 14:
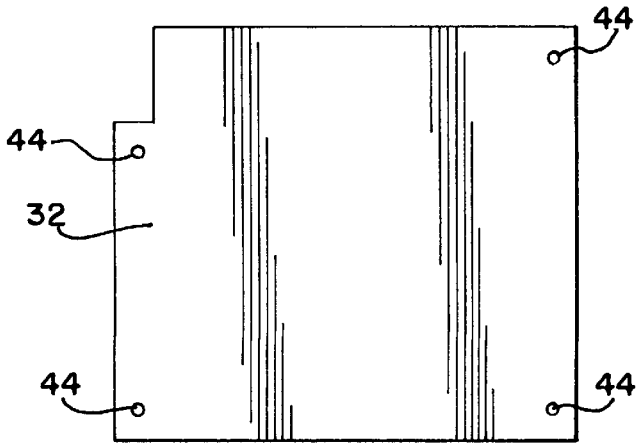
FIG. 14 is a plan view of one of the two outer plates of the resistor unit.

The details of the construction of the second resistor element 36 are shown in FIGS. 9, 11 and 13. The second resistor element 36 differs from the first resistor element 34 in that the second resistor element 36 is a dual resistor element which affords left-hand and right-hand resistance elements 110 and 112 which may also be referred to as the second and third resistance elements 110 and 112. The second resistor element 36 comprises first, second and third flat terminal conductors 114, 116 and 118 which may also be referred to as the left, central and right terminal conductors 114, 116 and 118. The second resistor element 36 is stamped or otherwise formed from flat electrically resistive sheet material preferably sheet-metal.

A left resistive maze 120 is formed between the left and central terminal conductors 114 and 116, and a right resistive maze 122 is formed between the central and right terminal conductors 116 and 118. The mazes 120 and 122 may also be referred as maze means 120 and 122. The left and right mazes 120 and 122 are intermingled in this case. The left maze 120 comprises a plurality of narrow resistive longitudinal ribbons 124 and transverse ribbons 126 which are interconnected to form one or more resistive paths between the left and central terminal conductors 114 and 116. Similarly, the right resistive maze 126 comprises a plurality of narrow resistive longitudinal ribbons 128 and transverse ribbons 130 which are interconnected to form one or more resistive paths between the central and right terminal conductors 116 and 118.

In FIG. 13, the ribbons 124 and 126 have been fully severed to form a single serpentine resistive path or ribbon 132 between the left and central terminal conductors 114 and 116. The serpentine path 132 starts at the rear end of the left terminal conductor 114 and comprises a short transverse ribbon 126, a long longitudinal ribbon 124 extending forwardly, a short transverse ribbon 126 extending to the right, a long longitudinal ribbon 124 extending rearwardly, a long transverse ribbon 126 extending to the right, a long longitudinal ribbon 124 extending forwardly, a short transverse ribbon 126 extending to left, a long longitudinal ribbon 124 extending rearwardly, a transverse ribbon 126 of medium length extending to the left, a long longitudinal ribbon 124 extending forwardly, a short transverse ribbon 126 extending to the left, a long longitudinal ribbon 124 extending rearwardly, a transverse ribbon 126 of medium length extending to the left, and a long longitudinal ribbon 124 extending forwardly to the central terminal conductor 116.

As shown in FIG. 13, the longitudinal and transverse ribbons 128 and 130 of the right maze 122 are interconnected to form a single serpentine resistive path or ribbon 134 between the central and right terminal conductors 116 and 118. The ribbons 128 and 130 of the serpentine path or ribbon 134 is wider than the ribbons 124 and 126 of the serpentine path or ribbon 132, so that the serpentine path 134 can readily be distinguished from the serpentine path 132. Beginning at the front of the central terminal conductor 116, the serpentine ribbon 134 comprises a long longitudinal ribbon 128 extending rearwardly, a medium length transverse ribbon 130 extending to right, a long longitudinal ribbon 128 extending forwardly, a medium length transverse ribbon 130 extending to the right, a long longitudinal ribbon 128 extending rearwardly, a medium length transverse ribbon 130 extending to the right, a long longitudinal ribbon 128 extending forwardly, a medium length transverse ribbon 130 extending to the right, a long longitudinal ribbon 128 extending rearwardly, and a short transverse ribbon 130 extending to the right and connecting in one piece with the rear end of the right terminal conductor 118.

FIG. 9 shows the second resistor element 36 in its initial condition, after it has been stamped from the electrically resistive sheet metal. In this condition, some of the longitudinal and transverse ribbons 124, 126, 128 and 130 are connected to one another and to the left, central and right terminal conductors 114, 116 and 118 by a plurality of temporary severable supporting tie webs or bridges 136 which are formed in one piece with the terminal conductors and the ribbons. The supporting webs 136 are left intact by the initial stamping of the second resistor element 36 for maintaining the structural integrity of the resistor element 36 so that it can be handled and shipped without any damage or difficulty.

Before the second resistor element 36 is assembled with the other components to form the finished resistor 30, the second resistor element 36 is subjected to a punching or other severing operation whereby all of the temporary severable supporting webs or bridges 136 are severed or otherwise removed from the resistor element 36, as shown in FIGS. 11 and 13. In this way, the serpentine resistive ribbons or paths 132 and 134 are electrically normalized. However, the second resistor element 36 is somewhat lacking in structural integrity in this condition, so that the element 36 must be carefully handled when it is assembled with the other components to form the finished resistor 30.

When the second resistor element 36 is originally stamped from the resistive sheet metal, as shown in FIG. 9, the resistor element 36 includes at least one severable bypass web, link or bridge 138 which extends between adjacent longitudinal ribbons 128 whereby a portion of the serpentine resistive ribbon or path 134 is electrically bypassed or short-circuited. As shown in FIGS. 9 and 11, a single bypass web or bridge 138 is connected between two of the adjacent longitudinal ribbons 128. As shown in FIG. 13, the bypass web or link 138 has been removed by a punching or severing operation so as to increase the resistance value of the serpentine resistive ribbon or path 134 between the central and right terminal conductors 116 and 118. Other similar bypass webs or bridges can be provided in the second resistor element 36, as originally stamped or otherwise formed, to reduce the resistance values of the serpentine paths or ribbons 132 and 134.

As shown in FIGS. 9, 11 and 13, the left, central and right terminal conductors 114, 116 and 118 are provided with left, central and right wire-like terminal prongs 140, 142 and 144, formed in one piece with the terminal conductors 114, 116 and 118. The wire-like prongs 140, 142 and 144 may be formed in the same manner as described in connection with the wire-like prongs 106 and 108.

Figure 7:
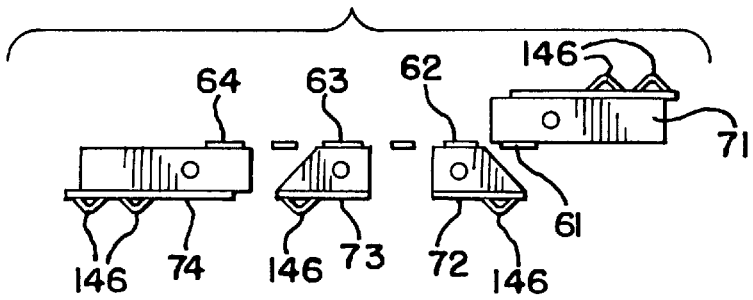
FIG. 7 is a diagrammatic rear elevational view showing the conductive metal terminals of the resistor unit, in the positions which they occupy when they are assembled with the electrically insulating component or body of the terminal head.

The wire-like prongs 108, 140, 142 and 144 of the resistance elements 34 and 36 are adapted to be connected to the terminals 72, 73 and 74 on the terminal head 56. To receive and anchor the wire-like prongs 108, 140, 142 and 144, each of the terminals 71 through 74 is formed with one or more pairs of shear formed loops 146, as shown to best advantage in FIG. 7, in which the terminals 71 through 74 are shown separately in their correct positions on the terminal head 56, but without actually showing the terminal head 56. The shear formed loops 146 are also shown in FIGS. 1, 2 and 4. From FIG. 2, it will be observed that the loops 146 are formed in aligned pairs, so that each of the wire-like prongs 108, 140, 142, and 144 can be inserted through the aligned loops 146 of the corresponding pair. The terminal 74 is formed with two pairs of the loops 146 for receiving two wire-like prongs 108 and 144, as shown in FIG. 2. All of the loops 146 are then strongly compressed or clenched so that the prongs 108, 140, 142 and 144 are securely and permanently clamped by the loops 146 against the corresponding terminals 72 through 74. Similar shear formed loops have been disclosed and used previously for clamping the wire ends of coiled wire resistors to terminals. The strong clamping action of the compressed loops 146 insures that good electrical contact is established and maintained between the prongs 108, 140, 142 and 144 and the corresponding terminals 72, 73 and 74.

The resistor unit 30 also comprises a thermal fuse or circuit breaker 148 which is adapted to interrupt the flow of electrical current in the resistor unit 30 when it becomes overheated to an unacceptably high temperature, due to the flow of excessive electrical current in the resistor unit 30 or abnormal lack of cooling air flow. The excessive current is often due to a fault in the blower motor in which the rotor of the motor becomes locked. When such a fault occurs, the resistor 30 may become heated to an unacceptably high temperature, well above the normal range. The resistor current passes through the thermal fuse or circuit breaker 148, but the circuit is broken when the fuse 148 is heated externally above its rated opening temperature by the heat generated in the resistor 30.

As shown to best advantage in FIGS. 2, 4, 5 and 6, the body of the fuse 148 is mounted or held against a seat or nest 150 formed on one edge of the midplate 40, so that heat is conductively transferred between the midplate 40 and the fuse 148. The heat generated by the resistance elements 34 and 36 is conductively transferred to the midplate 40 through the thin electrical inner insulators 38B.

As shown in FIGS. 2 and 5, the thermal fuse 148 is made with first and second end leads or wires 152 and 154. The first end wire 152 extends forwardly and is connected to the terminal 71, which has a pair of the shear formed loops 146 thereon, through which the lead 152 is inserted. The loops 146 are then forcibly compressed or clenched, whereby the wire 152 is securely and permanently clamped to the terminal 71.

The second end lead or wire 154 extends rearwardly from the thermal fuse 148 and is inserted through a pair of the shear formed loops 146 which are formed on a tab 156 projecting laterally on the midplate 40, which acts as an electrically conductive tie bar or terminal. The end lead 154 is slipped through the loops 146 which are then forcibly compressed or clenched, so as to clamp the lead or wire 154 securely against the tab 156.

The midplate 40 has a second tab 158 on which two of the loops 146 are formed, for receiving the rearwardly projecting wire-like prong 106 on the resistance element 34. The loops 146 are forcibly compressed or clenched so that the prong 106 is securely clamped to the tab 158. The midplate 40 serves as a tie bar or terminal between the end lead 154 of the thermal fuse 148 and the rearwardly projecting prong 106 on the resistance element 34. Thus, the thermal fuse 148 initially establishes an electrically conductive path between the wire-like prong 106 and the terminal 71.

The heat normally generated in the resistor 30 is conducted to the thermal fuse 148, so that the temperature of the thermal fuse 148 is raised to approximately the same temperature that is produced in the midplate 40 of the resistor 30. However, the thermal fuse 148 is selected to withstand the highest temperature that is normally produced in the midplate 40. If the temperature of the resistor 30 is raised to an abnormally high value, due to a fault in the blower motor, such as a locked rotor, the thermal fuse 148 is heated to a temperature which substantially exceeds its rated value, with the result that the fusible component in the fuse is melted, so that the resistor circuit is broken. The thermal fuse 148 prevents the development of a dangerously high temperature in and around the resistor 30, so that the hazard of a fire or other mishap is obviated.

Figures 16, 17, 18, 19, 20:
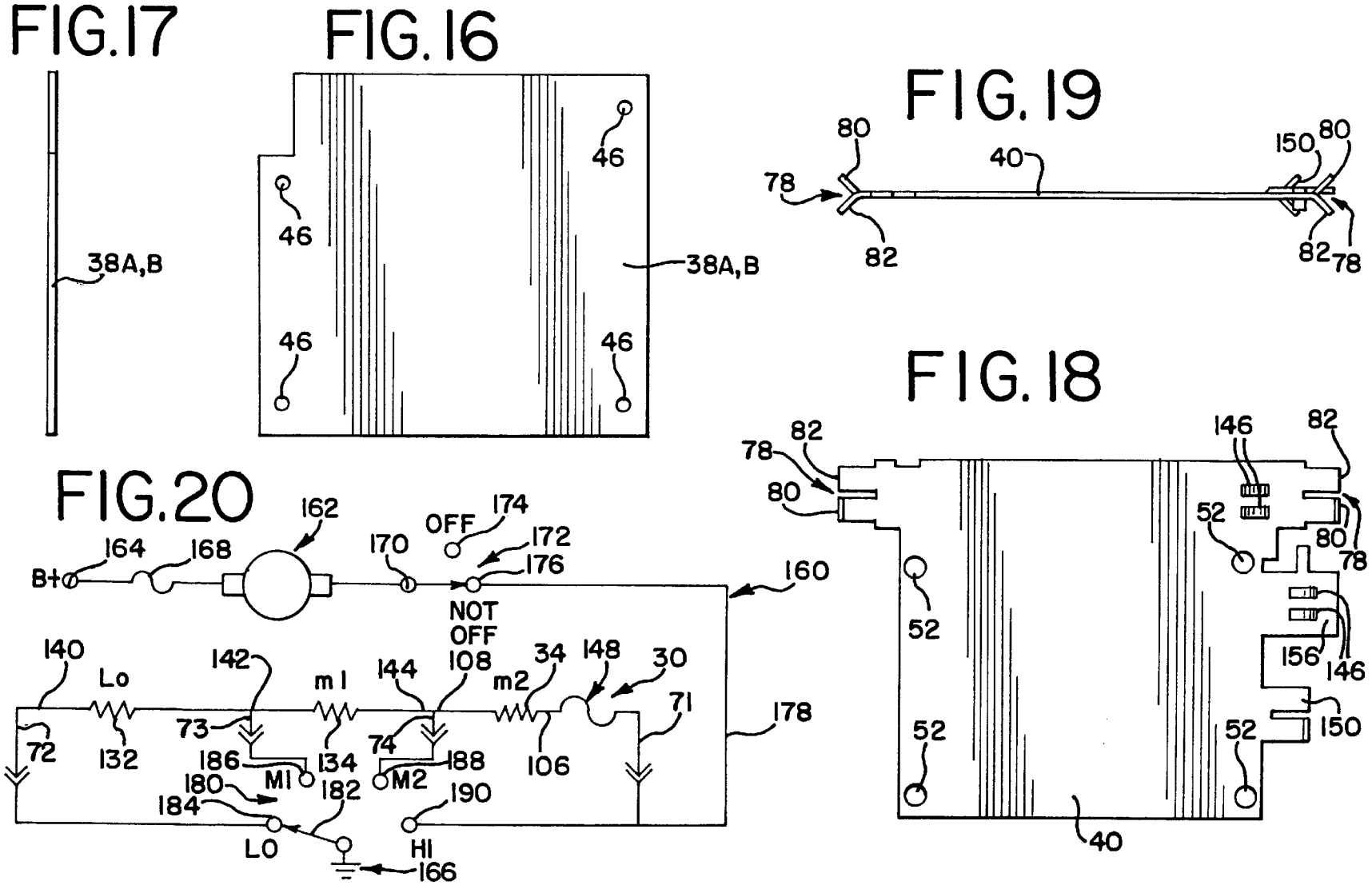
FIG. 16 is a plan view of one of the four flat insulators employed in the resistor unit.
FIG. 17 is an edge elevational view of the insulator of FIG. 16.
FIG. 18 is a plan view of the metal mid-plate employed in the resistor unit.
FIG. 19 is an edge elevational view of the mid-plate of FIG. 18.
FIG. 20 is a schematic electrical circuit diagram illustrating a typical use of the resistor unit for controlling the speed of a blower motor in an automotive air control system.

FIG. 20 is a schematic circuit diagram of an illustrative electrical circuit 160 whereby the resistor 30 is utilized to control the speed of a blower motor 162 for an automotive air control system, which may be employed for heating, ventilating and air conditioning an automotive vehicle. The control circuit 160 is adapted to be connected between the positive and negative terminals of the automotive battery, not shown. The circuit 160 comprises a B+ terminal 164 which is adapted to be connected to the positive terminal of the battery. The negative terminal of the battery is connected to the conductive frame of the vehicle. The control circuit 160 has a negative or ground terminal 166, shown in FIG. 20 as a ground symbol, representing a connection to the frame of the vehicle.

In the circuit 160, an ordinary fuse or circuit breaker 168 is connected in series with the blower motor 162 between the B+ terminal 164 and the movable contact 170 of a shutoff switch 172. The movable contact 170 is movable between a first fixed contact 174, labeled OFF and a second fixed contact 176 labeled NOT OFF, which could be designated the ON contact.

The circuit 160 comprises means including a conductor 178 connected between the second fixed contact 176 and the terminal 71 of the resistor 30 in which the components are connected in a series circuit between terminals 71 and 72. The series circuit comprises the thermal fuse 148, the midplate 40, the first resistance element 34, the terminal 74, the resistance element 134, the terminal 73, and the resistance element 132 which is connected to the terminal 72. When all three of the resistance elements, 34, 134 and 132 are connected in series with the blower motor 162, it is operated at its slowest speed.

A four-position speed control switch 180 is provided for progressively switching the resistance elements 132, 134 and 34 into and out of the circuit 160 to decrease and increase the speed of the motor 162. The illustrated switch 180 comprises a movable contact 182 which is connected to the negative terminal or ground 166 whereby the movable contact 182 is connected to the negative terminal of the automotive battery. The movable contact 182 is movable successively into engagement with a first fixed contact 184, labeled LO, a second fixed contact 186, labeled M1, a third fixed contact 188, labeled M2 and a fourth fixed contact 190, labeled HI.

The first fixed contact 184 is connected to the terminal 72 of the resistor 30. The second, third and fourth fixed contacts 186, 188 and 190 are connected to the resistor terminals 73, 74 and 71, respectively.

When the movable contact 182 engages the first fixed contact 184, all three of the resistance elements 132, 134 and 34 are connected in series with the blower motor 162, so that it operates at low speed. When the movable contact 182 engages the second fixed contact 186, the resistance elements 134 and 34 are connected in series with the motor 162, so that it operates at a first medium speed. When the movable contact 182 is engaged with the third fixed contact 188, only the resistance element 34 is connected in series with the motor 162, so that it operates at a higher medium speed. When the movable contact 182 engages the fourth fixed contact 190, none of the resistance elements 132, 134 and 34 is connected in series with the motor 162, so that it operates at its high or maximum speed.

We claim:

1. A layered electrical resistor, comprising a first thermally conductive metal outer plate, a first thin flat electrical insulator having one side engaging said outer plate, a first thin flat electrically resistive sheet metal resistor element separate from said first outer plate and said first insulator and stacked against said first insulator, a second thin flat electrical insulator separate from and stacked against said first resistor element, an electrically and thermally conductive metal midplate stacked against said second insulator, a third thin flat electrical insulator stacked against said midplate, a second thin flat electrically resistive sheet metal resistor element separate from said midplate and said third insulator and stacked against said third insulator, a fourth thin flat electrical insulator separate from and stacked against said second resistor element, a second thermally conductive outer metal plate stacked against said fourth insulator, and means for compressing said first and second outer plates toward each other with said insulators, said first and second resistor elements and said midplate securely compressed therebetween, each of said first and second resistor elements being in the form of a separate electrically resistive sheet metal stamping having at least first and second end terminals and a plurality of ribbons interconnected in one piece and affording a continuous electrically resistive path between said first and second end terminals, said midplate and said outer plates being effective to dissipate the heat generated by the flow of electrical current in said resistor elements.

2. A layered electrical resistor, comprising a first thermally conductive metal plate, a first thin flat electrical insulator having one side engaging said first plate, a thin flat electrically resistive sheet metal resistor element separate from and stacked against said first insulator, a second thin flat electrical insulator separate from and stacked against said resistor element, and means for compressing said first and second plates toward each other with said insulators and said resistor element securely compressed therebetween, said resistor element being in the form of an electrically resistive sheet metal stamping having at least first and second end terminals and a plurality of ribbons interconnected in one piece and affording a continuous electrically conductive path between said first and second end terminals, said plates being effective to dissipate the heat generated by the flow of electrical current in said resistor element.

3. A layered resistor according to claim 2, including a thermal circuit breaker in a heat-conductive relation with at least one of said plates, and means for connecting said resistor element and said thermal circuit breaker in a continuous electrical circuit, said thermal circuit breaker being initially conductive but becoming nonconductive when heated above a limiting temperature, whereby excessive heat produced in said resistor element is thermally conducted to said thermal circuit breaker which is effective to interrupt the flow of current in said resistor element to prevent development of an unacceptably high temperature therein.

4. A layered resistor according to claim 3, in which said thermal circuit breaker is a thermal fuse.

5. A layered resistor according to claim 3, in which one of said plates comprises means forming a seat for thermally conductive engagement by said thermal circuit breaker, said thermal circuit breaker being in thermal conductive engagement with said seat.

6. A layered resistor according to claim 2, in which said resistor element comprises at least one integral resistance adjusting bypass tie bar formed initially in one piece between two of said ribbons for electrically bypassing portions of said ribbons and thereby reducing the electrical resistance of said resistor element, said resistance adjusting bypass tie bar being optionally severable from said resistor element prior to assembly thereof with the other components of said resistor for increasing the electrical resistance of said resistor element.

7. A resistor element, comprising a thin flat electrically resistive sheet metal stamping having portions forming first and second end terminals and a plurality of ribbons interconnected in one piece and affording a continuous electrically resistive path between said first and second end terminals, each of said terminals comprising a generally rectangular tab which is elongated in a longitudinal direction and is initially flat but is folded twice upon itself along two different substantially longitudinal fold lines to form said tab into a three-layer wire-like end prong on the corresponding terminal.

8. A resistor element according to claim 7, comprising a multiplicity of said ribbons connected in series in a generally serpentine pattern and extending between said first and second end terminals in one piece therewith.

9. A resistor element according to claim 7, comprising a multiplicity of said ribbons formed in one piece with said terminals and extending in a plurality of parallel paths between said terminals.

10. A resistor element according to claim 7, comprising at least one integral structural tie bar extending between at least one of said ribbons and at least one adjacent portion of said resistor element for initially imparting enhanced structural integrity to said resistor element, said tie bar being severable from said resistor element prior to its going into service.

11. A layered electrical resistor, comprising a first thermally conductive metal outer plate, a first thin flat electrical insulator having one side engaging said outer plate, a first thin flat electrically resistive sheet metal resistor element separate from and stacked against said first insulator, a second thin flat electrical insulator separate from and stacked against said first resistor element, an electrically and thermally conductive metal midplate stacked against said second insulator, a third thin flat electrical insulator stacked against said midplate, a second thin flat electrically resistive sheet metal resistor element separate from and stacked against said third insulator, a fourth thin flat electrical insulator separate from and stacked against said second resistor element, a second thermally conductive outer metal plate stacked against said fourth insulator, and means compressing said first and second outer plates toward each other with said insulators, said first and second resistor elements and said midplate securely compressed therebetween, each of said first and second resistor elements being in the form of an electrically resistive cut-formed sheet metal element having at least first and second end terminals and a pattern of ribbons interconnected in one piece and affording a continuous electrically resistive path between said first and second end terminals, said midplate and said outer plates being effective to dissipate the heat generated by the flow of electrical current in said resistor elements.

12. A layered resistor according to claim 11, including a thermal circuit breaker in a heat-conductive relation with said midplate, means for connecting said first and second resistor elements and said thermal circuit breaker in a continuous electrical circuit, said thermal circuit breaker being initially conductive but becoming non-conductive when heated above a limiting temperature, whereby heat produced in said first and second resistor elements is thermally conducted by said midplate to said thermal circuit breaker which is effective to interrupt the flow of current in said resistor elements to prevent development of an unacceptably high temperature therein;

said midplate comprising means forming a seat for thermally conductive engagement by said thermal circuit breaker, said thermal circuit breaker being in thermally conductive engagement with said seat.

13. A layered electrical resistor according to claim 11, in which said first thin flat electrical insulator is separate from said first outer plate, said second thin flat electrical insulator being separate from said midplate, said third thin flat electrical insulator being separate from said midplate, said fourth thin flat electrical insulator being separate from said second outer plate.

14. A layered electrical resistor, comprising a first thermally conductive metal plate, a first thin flat electrical insulator having one side engaging said first plate, a thin flat electrically resistive sheet metal resistor element separate from and stacked against said first insulator, a second thin flat electrical insulator separate from and stacked against said resistor element, a second thermally conductive metal plate stacked against said second insulator, and means for compressing said first and second plates toward each other with said insulators and said resistor element securely compressed therebetween, said resistor element being in the form of an electrically resistive cut-formed sheet metal element having at least first and second end terminals and a pattern of ribbons interconnected in one piece and affording a continuous electrically conductive path between said first and second end terminals, said plates being effective to dissipate the heat generated by the flow of electrical current in said resistor element.

15. A layered resistor according to claim 14, including a thermal circuit breaker in a heat-conductive relation with at least one of said plates, and means for connecting said resistor element and said thermal circuit breaker in a continuous electrical circuit, said thermal circuit breaker being initially conductive but becoming nonconductive when heated above a limiting temperature, whereby heat produced in said resistor element is thermally conducted to said thermal circuit breaker which is effective to interrupt the flow of current in said resistor element to prevent development of an unacceptably high temperature therein.

16. A layered electrical resistor according to claim 14, in which said first thin flat electrical insulator is separate from said first metal plate, said second thin flat electrical insulator being separate from said second metal plate.

17. An electrical resistor element for a layered resistor, comprising a thin flat electrically resistive cut-formed sheet metal element having portions forming at least first and second end terminals and a pattern of ribbons interconnected in one piece and affording a continuous electrically resistive path between said first and second end terminals, each of said terminals comprising a generally rectangular tab which is elongated in a longitudinal direction and is initially flat but is folded twice upon itself along substantially longitudinal fold lines to form said tab into a three layered wire-like prong on the corresponding terminal.

18. A resistor element according to claim 17, comprising at least one integral structural tie bar extending between at least one of said ribbons and at least one adjacent portion of said resistor element for initially imparting enhanced structural integrity to said resistor element, said tie bar being severable from said resistor element prior to its going into service.

19. A layered electrical resistor, comprising a first thermally conductive metal outer plate, a first thin flat electrical insulator having one side engaging said outer plate, a first thin flat electrically resistive sheet metal resistor element stacked against said first insulator, a second thin flat electrical insulator stacked against said first resistor element, an electrically and thermally conductive metal midplate stacked against said second insulator, a third thin flat electrical insulator stacked against said midplate, a second thin flat electrically resistive sheet metal resistor element stacked against said third insulator, a fourth thin flat electrical insulator stacked against said second resistor element, a second thermally conductive outer metal plate stacked against said fourth insulator, and means for connecting and compressing said first and second outer plates together with said insulators, said first and second resistor elements and said midplate securely compressed therebetween, each of said first and second resistor elements being in the form of an electrically resistive sheet metal stamping having at least first and second end terminals and a plurality of ribbons interconnected in one piece and affording a continuous electrically resistive path between said first and second end terminals, said midplate and said outer plates being effective to dissipate the heat generated by the flow of electrical current in said resistor elements, said layered resistor including a thermal circuit breaker in a heat-conductive relation with said midplate, means for connecting said first and second resistor elements and said thermal circuit breaker in a continuous electrical circuit, said thermal circuit breaker being initially conductive but becoming non-conductive when heated above a limiting temperature, whereby excessive heat produced in said first and second resistor elements is thermally conducted by said midplate to said thermal circuit breaker which is effective to interrupt the flow of current in said resistor elements to prevent development of an unacceptably high temperature therein.

20. A layered resistor according to claim 19, in which said thermal circuit breaker is a thermal fuse.

21. A layered resistor according to claim 19, in which said midplate comprises means forming a seat for thermally conductive engagement by said thermal circuit breaker, said thermal circuit breaker being in thermally conductive engagement with said seat.

22. A layered resistor according to claim 21, including at least one flange on said midplate for forming said seat thereon for engagement by said thermal circuit breaker.

23. A layered resistor according to claim 19, in which at least one of said resistor elements comprises at least one integral structural tie bar extending in one piece between at least one of said ribbons and at least one of said terminals for initially imparting enhanced structural integrity to said resistor element, said tie bar being severable from the resistor element prior to assembly thereof with the other components of said resistor.

24. A layered resistor according to claim 19, in which each of said end terminals of said resistor elements comprises a generally rectangular tab which is initially flat but is folded twice upon itself to form said tab into a three-layer wire-like prong thereon.

25. A layered resistor according to claim 24, in which said midplate comprises a plurality of terminal receiving portions having respective sets of metal loops sheared from said midplate, one prong on one of said resistor elements being received in one set of said loops for establishing an electrical connection thereto, said resistor including a terminal lead received in another set of said loops, said loops being adapted to be clenched against the terminal prong and the terminal lead for clamping engagement therewith to provide secure electrical connections thereto.

26. A layered resistor according to claim 24, comprising an electrically insulating terminal head having a plurality of metal terminal prongs mounted thereon, said terminal prongs having metal loops sheared therefrom for receiving certain of said wire-like prongs on said resistor elements, said loops being adapted to be clenched against said wire-like prongs into clamping engagement therewith.

27. A layered resistor according to claim 26, in which said terminal head comprises a pair of supporting channels formed in one piece with said terminal head and extending transversely thereto, said midplate having edge portions for reception in said channels whereby said channels support said midplate.

28. A layered resistor according to claim 19, in which said first resistor element comprises an intermediate terminal and a plurality of ribbons interconnected in one piece and affording a continuous electrically resistive path between said first end terminal and said intermediate terminal and also between said intermediate terminal and said second end terminal of said first resistor element.

29. A layered resistor according to claim 28, in which said intermediate terminal comprises a generally rectangular tab which is initially flat but is folded twice upon itself to form said tab into a three-layer wire-like prong thereon.

30. A layered resistor according to claim 19, in which said second and third electrical insulators are thinner than said first and fourth electrical insulators so that the heat conductivity of said second and third insulators is greater than the heat conductivity of said first and fourth insulators, whereby heat generated in said first and second resistor elements is conducted at a greater rate by said second and third insulators to said midplate than the rate of heat conduction by said first and fourth insulators to said outer plates, so that said midplate is hotter than said outer plates and is effective under fault conditions to cause said thermal circuit breaker to interrupt the flow of electrical current in said resistor elements before an unacceptably high temperature is developed in said outer plates.

31. A layered electrical resistor, comprising a first thermally conductive metal plate, a first thin flat electrical insulator having one side engaging said first plate, a thin flat electrically resistive sheet metal resistor element stacked against said first insulator, a second thin flat electrical insulator stacked against said resistor element, a second thermally conductive metal plate stacked against said second insulator, and means for connecting and compressing said first and second plates together with said insulators and said resistor element securely compressed therebetween, said resistor element being in the form of an electrically resistive sheet metal stamping having at least first and second end terminals and a plurality of ribbons interconnected in one piece and affording a continuous electrically conductive path between said first and second end terminals, said plates being effective to dissipate the heat generated by the flow of electrical current in said resistor element, said layered resistor including a thermal circuit breaker in a heat-conductive relation with at least one of said plates, and means for connecting said resistor element and said thermal circuit breaker in a continuous electrical circuit, said thermal circuit breaker being initially conductive but becoming nonconductive when heated above a limiting temperature, whereby excessive heat produced in said resistor element is thermally conducted to said thermal circuit breaker which is effective to interrupt the flow of current in said resistor element to prevent development of an unacceptably high temperature therein, one of said plates comprising means forming a seat for thermally conductive engagement by said thermal circuit breaker, said thermal circuit breaker being in thermal conductive engagement with said seat, said layered resistor including at least one flange on said one of said plates for forming said seat thereon for engagement by said thermal circuit breaker.

32. A layered electrical resistor, comprising a first thermally conductive metal plate, a first thin flat electrical insulator having one side engaging said first plate, a thin flat electrically resistive sheet metal resistor element stacked against said first insulator, a second thin flat electrical insulator stacked against said resistor element, a second thermally conductive metal plate stacked against said second insulator, and means for connecting and compressing said first and second plates together with said insulators and said resistor element securely compressed therebetween, said resistor element being in the form of an electrically resistive sheet metal stamping having at least first and second end terminals and a plurality of ribbons interconnected in one piece and affording a continuous electrically conductive path between said first and second end terminals, said plates being effective to dissipate the heat generated by the flow of electrical current in said resistor element, said resistor element comprising at least one integral structural tie bar extending in one piece between at least one of said ribbons and at least one of said terminals for initially imparting enhanced structural integrity to said resistor element, said tie bar being severable from the resistor element prior to assembly thereof with the other components of said resistor.

33. A layered electrical resistor, comprising a first thermally conductive metal plate, a first thin flat electrical insulator having one side engaging said first plate, a thin flat electrically resistive sheet metal resistor element stacked against said first insulator, a second thin flat electrical insulator stacked against said resistor element, a second thermally conductive metal plate stacked against said second insulator, and means for connecting and compressing said first and second plates together with said insulators and said resistor element securely compressed therebetween, said resistor element being in the form of an electrically resistive sheet metal stamping having at least first and second end terminals and a plurality of ribbons interconnected in one piece and affording a continuous electrically conductive path between said first and second end terminals, said plates being effective to dissipate the heat generated by the flow of electrical current in said resistor element, each of said end terminals of said resistor element comprising a generally rectangular tab which is initially flat but is folded twice upon itself to form said tab into a three-layer wire-like prong thereon.

34. A layered resistor according to claim 33, in which one of said plates comprises at least one terminal receiving portion having metal loops sheared from said plate for receiving one of said wire-like prongs on said resistor element to connect said resistor element to said one plate, said loops being adapted to be clenched against the corresponding prong for clamping engagement therewith.

35. A resistor element, comprising a thin flat electrically resistive sheet metal stamping having portions forming first and second end terminals and a plurality of ribbons interconnected in one piece and affording a continuous electrically resistive path between said first and second end terminals, each of said terminals comprising a generally rectangular tab which is initially flat but is folded twice upon itself to form said tab into a three-layer wire-like prong on the corresponding terminal, said resistor comprising at least one resistance adjusting bypass tie bar formed initially in one piece between two of said ribbons for electrically bypassing portions of said ribbons and thereby reducing the electrical resistance of said resistor element, said resistance adjusting bypass tie bar being optionally severable from said resistor element prior to its going into service.

36. A resistor element, comprising a thin flat electrically resistive sheet metal stamping having portions forming first and second end terminals and a plurality of ribbons interconnected in one piece and affording a continuous electrically resistive path between said first and second end terminals, each of said terminals comprising a generally rectangular tab which is initially flat but is folded twice upon itself to form said tab into a three-layer wire-like prong on the corresponding terminal, said resistor comprising an intermediate terminal between said first and second end terminals, a plurality of said ribbons being interconnected in one piece and affording a continuous electrically resistive path between said first end terminal and said intermediate terminal, said resistor comprising an intermediate terminal between said first and second end terminals, a plurality of said ribbons also being interconnected in one piece and affording a continuous electrically resistive path between said intermediate terminal and said second end terminal.

37. A layered electrical resistor, comprising a first thermally conductive metal outer plate, a first thin flat electrical insulator having one side engaging said outer plate, a first thin flat electrically resistive metal resistor element stacked against said first insulator, a second thin flat electrical insulator stacked against said first resistor element, an electrically and thermally conductive metal midplate stacked against said second insulator, a third thin flat electrical insulator stacked against said midplate, a second thin flat electrically resistive sheet metal resistor element stacked against said third insulator, a fourth thin flat electrical insulator stacked against said second resistor element, a second thermally conductive outer metal plate stacked against said fourth insulator, and means for connecting and compressing said first and second outer plates together with said insulators, said first and second resistor elements and said midplate securely compressed therebetween, each of said first and second resistor elements being in the form of an electrically resistive sheet metal stamping having at least first and second end terminals and a plurality of ribbons interconnected in one piece and affording a continuous electrically resistive path between said first and second end terminals, said midplate and said outer plates being effective to dissipate the heat generated by the flow of electrical current in said resistor elements, each of said end terminals of said resistor elements comprising a generally rectangular tab which is initially flat but is folded twice upon itself to form said tab into a three-layer wire-like prong thereon, said midplate comprising a plurality of terminal receiving portions having respective sets of metal loops sheared from said midplate, one prong on one of said resistor elements being received in one set of said loops for establishing an electrical connection thereto, said resistor including a terminal lead received in another set of said loops, said loops being adapted to be clenched against the terminal prong and the terminal lead for clamping engagement therewith to provide secure electrical connections thereto, said layered resistor including a thermal circuit breaker in a thermally conductive relation with said midplate, said terminal lead being connected to said thermal circuit breaker to establish an electrical connection between said thermal circuit breaker and said midplate, whereby said midplate establishes an electrical connection between said thermal circuit breaker and said one prong of one of said resistor elements.

38. A layered resistor according to claim 37, in which said thermal circuit breaker is a thermal fuse having a pair of terminal wires, one of said terminal wires constituting said terminal lead connected to said midplate.

* * * * *